United States Patent [19]

Ferris

[11] Patent Number: 4,745,772

[45] Date of Patent: May 24, 1988

[54] AIR CONDITIONER AUXILIARY FILTER/DRIER REFRIGERANT AND CHEMICAL ADDITIVE TRANSFER DEVICE

[76] Inventor: James E. Ferris, 15 High Mesa Pl., Richardson, Tex. 75080

[21] Appl. No.: 40,073

[22] Filed: Apr. 20, 1987

[51] Int. Cl.[4] ..... F25B 43/00

[52] U.S. Cl. ..... 62/292; 62/474

[58] Field of Search ..... 62/77, 85, 292, 474

[56] References Cited

U.S. PATENT DOCUMENTS

| | | | |
|---|---|---|---|
| 2,577,834 | 12/1951 | Wenk | 62/474 |
| 2,579,053 | 12/1951 | Schulstadt | 62/474 X |
| 3,086,392 | 4/1963 | Ehrens | 62/77 X |
| 3,175,342 | 3/1965 | Balogh | 62/85 X |
| 3,221,478 | 12/1965 | Norton | 55/281 |
| 3,232,070 | 2/1966 | Sparano | 62/77 X |
| 3,243,969 | 4/1966 | Dirk | 62/292 X |
| 3,976,110 | 8/1976 | White | 62/77 X |
| 4,255,940 | 3/1981 | Grahl et al. | 62/474 X |
| 4,266,408 | 5/1981 | Krause | 62/85 X |
| 4,363,222 | 12/1982 | Cain | 62/292 |

*Primary Examiner*—William E. Tapolcai
*Attorney, Agent, or Firm*—Warren H. Kintzinger

[57] ABSTRACT

A portable air conditioner drier and chemical additive system feeder particularly useful for home and auto air conditioning systems. The unit is an in-line filter/drier with an input flexible line section and an output flexible line section connectable from a system high pressure fitting to the refrigerant system suction side valve fitting so that a portion of the system pumps high pressure gas output through the filter/drier for a short contaminant, moisture, and air removal running period of time generally to an extent of twenty to forty minutes. The filter/-drier unit includes a screw top container that seals against leakage when threaded down normally containing a screen and filter material with a fill of desiccant particles cartridge which can be removed and replaced. With the filter desiccant cartridge removed and the container top open chemical additive fluids may be poured in with the unit attached to the low pressure fitting, the top threaded down again and the high pressure side reconnected to the system high pressure fitting or to a refrigerant material supply can to force flow the chemical additive fluids to the air conditioning system. A high pressure fitting adapter is used on the input flexible line section for connection to a system high pressure valve fitting of some systems.

17 Claims, 2 Drawing Sheets

Figure 1:
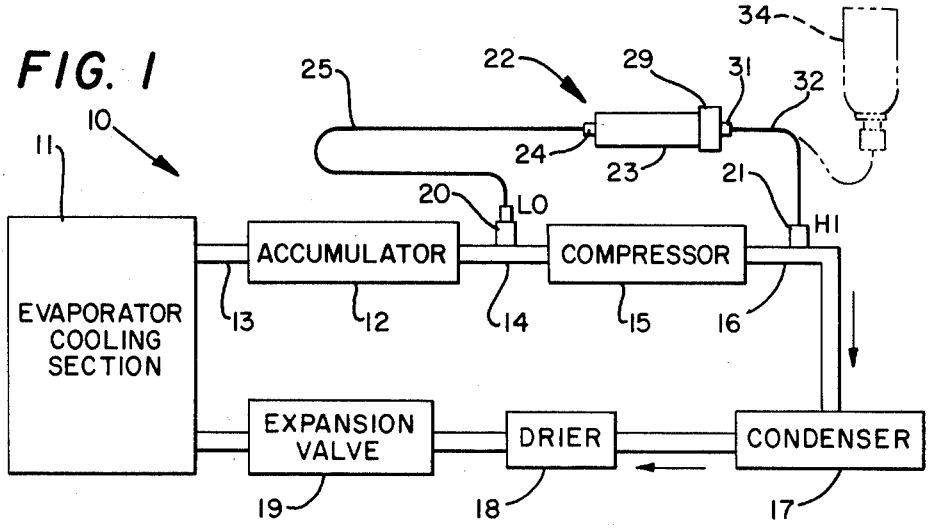

AIR CONDITIONER AUXILIARY FILTER/DRIER REFRIGERANT AND CHEMICAL ADDITIVE TRANSFER DEVICE

This invention relates in general to air conditioner system fluid decontamination, and more particularly, to an air conditioner moisture drier, contaminant and air remover and, alternately, fluid additive charger.

Removal of contaminants and moisture from air conditioning systems is important for effeciency of service and extended service life with minimal maintenance requirements being imposed. It is a great step forward if this can be accomplished without taking a unit out of service and/or without discarding the refrigerant from the system. This alone could save millions of pounds of refrigerant gases a year from being released and from attacking the ozone layer in the atmosphere. Air conditioner contamination eventually results in compressor failure (presently at the rate of approximately three million units per year) costing generally in the rate of 250 to 350 dollars each to replace. Clean, dry refrigerant lets your air conditioner run cooler and trouble free. Air conditioning system in-line driers in the liquid line of the system can not remove contaminants removeable by an auxiliary filter/drier operating between a high pressure fitting out of the system compressor and a low pressure fitting in a line on the input side of the compressor where the auxiliary filter/drier is working on refrigerant flow in the hot vapor state. The replacement of air conditioner driers presently runs to approximately ten million units annually with such replacement expensive and time consuming. This can be greatly reduced since periodic use of the auxiliary filter/drier for twenty to forty minute intervals can greatly reduce replacement of system driers. It not only removes contaminants and moisture from the system but does so to such extent as to even draw contaminants and moisture from system driers and further to such extent as to at least in part recondition the system driers. It is well known that clean, dry refrigerant lets an air conditioner run cooler and trouble free. The auxiliary filter/drier unit can be a one time purchase useable over and over, and that can be used as a charging hose when installing new refrigerant in an air conditioning system.

It is therefore a principal object of this invention to provide for efficient removal of contaminants and moisture from air conditioning systems.

Another object is to reduce air conditioner compressor failure and replacement costs and reduce drier replacement requirements.

A further object is to enable air conditioners to run cooler and trouble free.

Still another object is to provide an auxiliary filter/drier that is useable periodically for short intervals removing contaminants and moisture of air conditioner systems without taking the unit out of service and without discarding the system refrigerant.

Another object is to, through use of such an auxiliary filter/drier and not dumping refrigerant, save millions of pounds of regrigerant gases a year from attacking the ozone layer in the atmosphere.

Features of the invention useful in accomplishing the above objects include, in an air conditioner auxiliary filter/drier refrigerant and chemical additive transfer device, an in-line filter/drier with an input flexible line section and output flexible line section connectable from a system high pressure fitting to the refrigerant system suction side valve fitting so that a portion of the system pumps high pressure gas output through a filter/drier for a short contaminant moisture and air system removal running period of time generally to a time extent of twenty to forty minutes. The filter/drier unit includes a screw top container that seals against leakage when threaded down normally containing a screen and filter material with a fill of desicant particles cartridge which can be removed and replaced. With the filter desiccant cartridge removed and the container top open, chemical additive fluids may be poured in with the unit attached to the low pressure fitting, the top threaded down again and the high pressure side reconnected to the system high pressure fitting or to a refrigerant material supply can to force flow the chemical additive fluids to the air conditioning system. A high pressure fitting adapter is used on the input flexible line section for connection to a system high pressure valve fitting of some systems. The output flexible line section has a ball check valve equipped screw on valve fitting that is threaded on the refrigerant system suction side valve fitting first before the input flexible line section valve fitting end is threaded on to the system high pressure fitting or to a refrigerant material supply can.

A specific embodiment representing what is presently regarded as the best mode of carrying out the invention is illustrated in the accompanying drawings.

Figure 2:
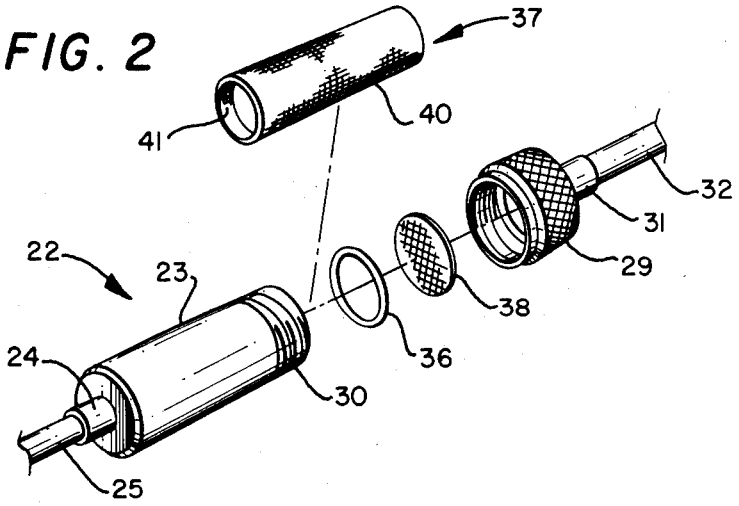
Figure 3:
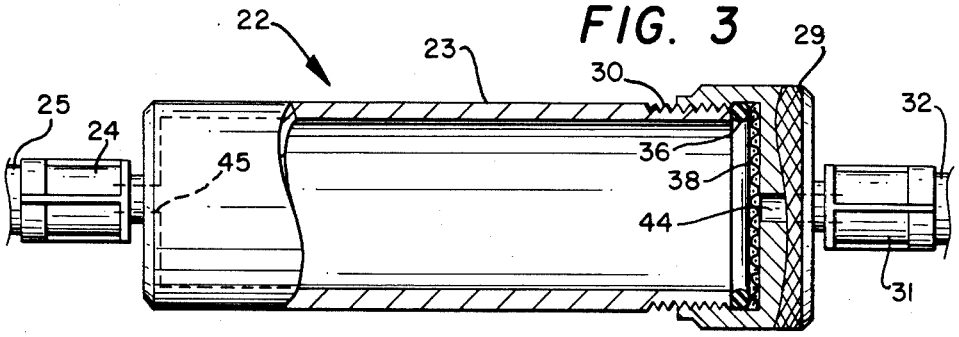
Figure 4:
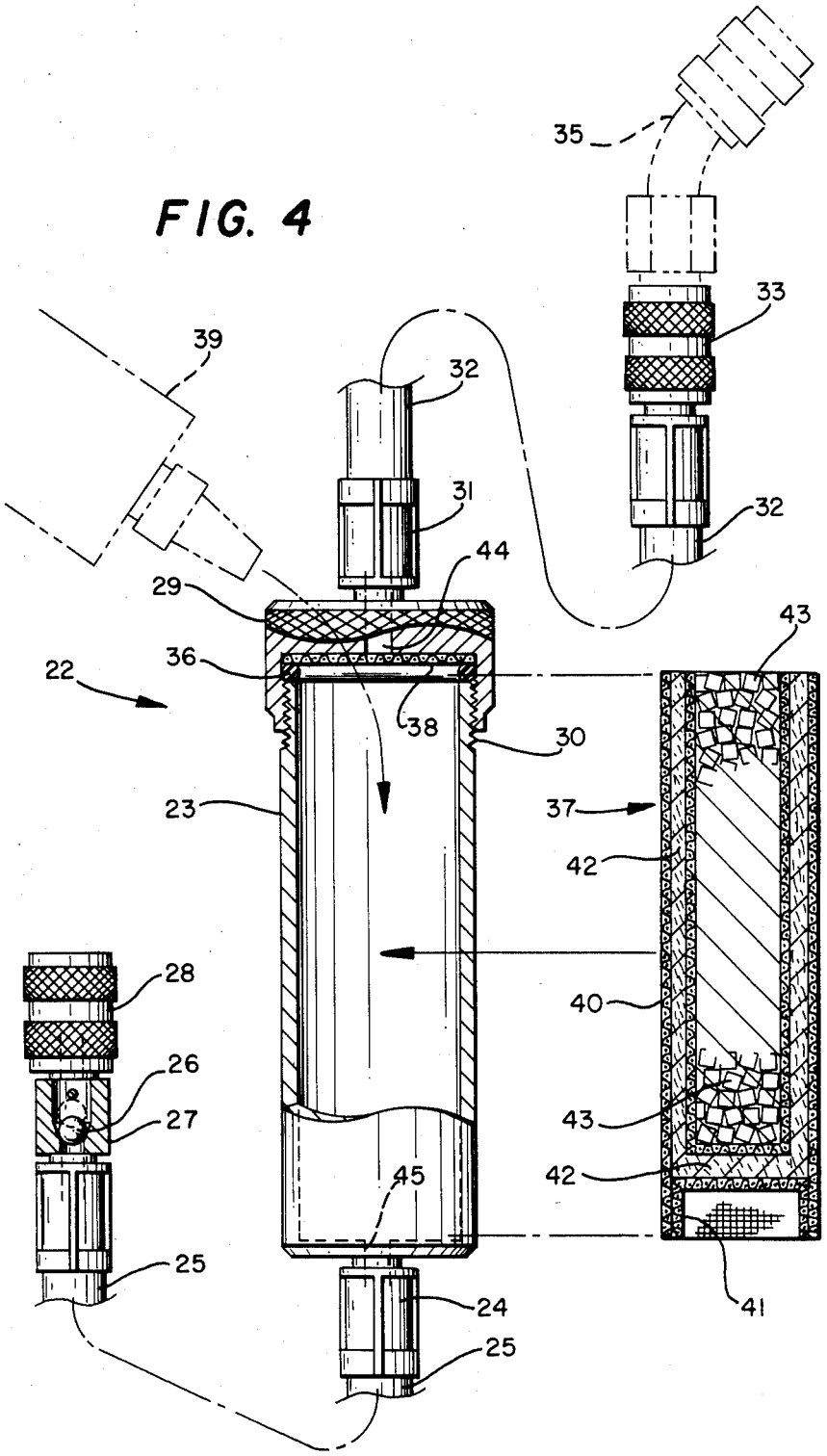

In the drawings:

FIG. 1 represents a block schematic showing of an air conditioning system with the portable auxiliary filter/drier connected in place between a system high pressure fitting and a suction side valve fitting around the system compressor, and, in phantom, the alternative as a refrigerant and chemical additive transfer device connected to a refrigerant material supply can;

FIG. 2, a partial perspective exploded view of the filter/drier and chemical additive transfer portion of the portable filter/drier unit of FIG. 1;

FIG. 3, a partially cut away and sectioned view of the filter/drier and chemical additive fillable chamber portion of the portable filter/drier unit of FIGS. 1 and 2; and FIG. 4, a partially cut away and sectioned view of the portable filter/drier unit of FIGS. 1, 2 and 3 with additional low pressure end ball check fitting detail and detail of the combination screen and filter container filled with desiccant particles that can be removed and replaced.

Referring to the drawings:

The air conditioning system 10 of FIG. 1 is, generally, a standard air conditioning system including an evaporator cooling section 11 in fluid communication with an accumulator 12 through fluid flow line 13. The accumulator 12 connected through low pressure suction line 14 to compressor 15 that has a high pressure output line 16 connection to condenser 17. In completion of the fluid flow loop in the direction indicated by arrows the condenser 17 output is connected, successively, through drier 18 and expansion valve 19 back to the evaporator cooling section 11. The low pressure suction line 14 to compressor 15 is provided with a low pressure valve fitting 20 and the high pressure output line 16 is shown to have a high pressure valve fitting 21. A portable filter/drier unit 22 is shown to be connected across the compressor 15 from the high pressure valve fitting 21 to the low pressure valve fitting 20.

Referring also to FIGS. 2, 3 and 4 the portable filter/drier unit 22 is shown to have a cylindrical container 23 having a bottom fitting 24 connection to an output flexible line section 25 equipped with a ball 26 check valve 27 equipped screw on fitting 28 that is threadable on low pressure valve fitting 20 in low pressure suction line 14. The cylindrical container 23 is equipped with a screw on top 29 that is removeably threaded on container top threads 30 and that is provided with a top fitting 31 connection to an input flexible line section 32 having a screw on fitting 33 at its end for screwed on connection with high pressure valve fitting 21 or to a refrigerant material supply can 34 such as shown in phantom in FIG. 1. A high pressure fitting adapter 35 is used in screw on fitting 33 of the input flexible line section 32 for threaded on connection to a system high pressure valve fitting or refrigerant material supply can with different size fitting threads. The cylindrical container 23 and the screw on top 29 are provided with an "O' ring seal 36 that seals the cylindrical container 23 and top 29 with the top tightened down whether a filter and desiccant cartridge 37 is in place contained therewithin or not. A screen 38 is included in top 29 above "O' ring seal 36 and when the top 29 is removed chemical fluid additives may be poured into the cylindrical container 23 from an additive supply container 39 as indicated in phantom in FIG. 4. The filter and desiccant cartridge 37 is shown to have a cup shaped cylindrical outer screen 40 with a recessed bottom open portion 41 and contains a cup shaped filter and inner screen assembly 42. The cup shaped filter and inner screen assembly 42 is shown to be filled with desiccant crystals (or particles) 43 that may be periodically replaced. It should be noted that the cylindrical container 23 is sized to accept at least two ounces of chemical additive fluid from any additive supply container 39 with the filter and desiccant cartridge 37 not in place therein. The cylindrical container 23 is provided with an entrance opening 44 in screw on top 29 from input flexible line section 32 and an outlet opening 45 in the container 23 bottom for out flow of refrigerant material fluids and/or gas or additives to the low pressure valve fitting 20 to low pressure suction line 14 and system compressor 15. While not shown it should be realized that the cup shaped filter and inner screen assembly 42 could be simplified with some filter materials not requiring an inner screen and that the filter could assume the shape of a disc in the bottom of the cup shaped cylindrical outer screen 40 particularly if the filter material extends peripherally into the screening itself. A like disc could also be provided in the top of the cup shaped cylindrical outer screen 40 enclosing desiccant material 43 contained therein as a cartridge 37. A typical fitting 28 to fitting 33 length for the portable filter/drier unit is four feet.

The fitting 28 is normally threaded on low pressure valve fitting 20 first with the ball 26 check valve 27 preventing refrigerant loss from the system. Then with the container 23 closed with screw on top 29 tightened down the fitting (or adapter 35) is threaded on high pressure valve fitting 21 or the outlet of a refrigerant material supply can 34. The portable filter/drier unit 22 is a do-it-yourself piece of equipment for the removal of contaminants and moisture from air conditioning systems without taking the unit out of service or discarding refrigerant to the atmosphere. Savings in refrigerant gases alone could run to millions of pounds per year that otherwise rise to attack the ozone layer in the atmosphere. The unit needs to be used on all auto air conditioners that have been in service over one year and mandatorily if there has been refrigerant loss. Air, oxygen, moisture and other contaminants can only be removed by vacuum pumping the system or by utilizing the easy to use, fast acting, safe to use and relatively inexpensive portable filter/drier unit 22. This unit 22, normally used thirty minutes at a time, filters and dries the system refrigerant when it is in the hot vapor state. In doing so it removes contaminants that an in-line permanent drier can not remove even when it is new with such permanently installed driers operating on liquid state refrigerant in a system. The portable unit is efficient enough in its drying and decontamination action as to at least partially recondition permanently installed system driers. Otherwise, required receiver drier replacement (running to some ten million units annually) is expensive and time consuming. The portable unit 22 is normally a one time purchase that can be used over and over particularly with replaceable desiccant cartridges, and that can be used as an additive charging hose with additive inserted in the container 23 of the unit and then connected between fittings 20 and 21 or with charging of refrigerant connected to a refrigerant material supply can 34 and with the compressor 15 running.

Whereas this embodiment has been described particularly with respect to a single embodiment thereof, it should be realized that various changes may be made without departure from the essential contributions to the art made by the teachings hereof.

I claim:

1. An air conditioner refrigerant auxiliary filter/drier unit comprising: a screw top cylindrical container that may be opened and closed with a screw top that seals the container against leakage when threaded down; a fluid inlet transfer line connected to said screw top for the feeding of fluid through opening means in said screw top and extended to a screw on fitting connectable to a high pressure fitting of an air conditioning system; an opening connection at the bottom of said screw top cylindrical container; a fluid outlet transfer line connected to said opening connection and extended to a screw on fitting connectable to a low pressure fitting of an air conditioning system; and desiccant containing filter screen member placeable in said screw top cylindrical container; wherein said desiccant containing filter screen member is a cup shaped member that when placed in said screw top cylindrical container occupies substantially the internal length of said screw top cylindrical container; an "O" ring seal is positioned between the top rim of said screw top cylindrical container and the inside top surface of said screw top; and wherein a disc of screening material is positioned inside said screw top and above said "O" ring.

2. The refrigerant auxiliary filter/drier unit of claim 1, wherein a cup of filter material is held in said cup shaped filter screen member.

3. The refrigerant auxiliary filter/drier unit of claim 2, wherein said cup of filter material is filled with desiccant particles.

4. The refrigerant auxiliary filter/drier unit of claim 3, wherein said cup shaped filter screen member is formed with a bottom disc shaped chamber for optimized fluid flow from the filter on out through said opening connection at the bottom of said screw top cylindrical container.

5. The refrigerant auxiliary filter/drier unit of claim 1, wherein said cup shaped filter screen member is formed with a bottom disc shaped chamber for optimized fluid flow from the filter on out through said opening connection at the bottom of said screw top cylindrical container.

6. An air conditioner refrigerant auxiliary filter/drier unit comprising: a screw top cylindrical container that may be opened and closed with a screw top that seals the container against leakage when threaded down; a fluid inlet transfer line connected to said screw top for the feeding of fluid through opening means in said screw top and extended to a screw on fitting connectable to a high pressure fitting of an air conditioning system; an opening connection at the bottom of said screw top cylindrical container; a fluid outlet transfer line connected to said opening connection and extended to a screw on fitting connectable to a low pressure fitting of an air conditioning system; and desiccant containing filter screen member placeable in said screw top cylindrical container; wherein said desiccant containing filter screen member is a cup shaped member that when placed in said screw top cylindrical container occupies substantially the internal length of said screw top cylindrical container; and "O' ring seal is positioned between the top rim of said screw top cylindrical container and the inside top surface of said screw top; a cup of filter material is held in said cup shaped filter screen member; said cup of filter material is filled with desiccant particles; said cup shaped filter screen member is formed with a bottom disc shaped chamber for optimized fluid flow from the filter on out through said opening connection at the bottom of said screw top cylindrical container; a cup of filter material is held in said cup shaped filter screen member; and an inner cup shaped screen member lines the interior of said cup of filter material.

7. An air conditioner refrigerant auxiliary filter/drier unit comprising: a screw top cylindrical container that may be opened and closed with a screw top that seals the container against leakage when threaded down; a fluid inlet transfer line connected to said screw top for the feeding of fluid through opening means in said screw top and extended to a screw on fitting connectable to a high pressure fitting of an air conditioning system; an opening connection at the bottom of said screw top cylindrical container; a fluid outlet transfer line connected to said opening connection and extended to a screw on fitting connectable to a low pressure fitting of an air conditioning system; and desiccant containing filter screen member placeable in said screw top cylindrical container; wherein said desiccant containing filter screen member is a cup shaped member that when placed in said screw top cylindrical container occupies substantially the internal length of said screw top cylindrical container; said cup shaped filter screen member is formed with a bottom disc shaped chamber for optimized fluid flow from the filter on out through said opening connection at the bottom of said screw top cylindrical container; and wherein a cup of filter material is held in said cup shaped filter screen member and an inner cup shaped screen member lines the interior of said cup of filter material.

8. The refrigerant auxiliary filter/drier unit of claim 7, wherein a check valve is included with said screw on fitting connected to said fluid outlet transfer line.

9. The refrigerant auxiliary filter/drier unit of claim 8, wherein a fitting adapter is provided insertable into said screw on fitting on said fluid inlet transfer line.

10. The refrigerant auxiliary filter/drier unit of claim 8, wherein said refrigerant auxiliary filter/drier unit is a portable unit connectable from a high pressure fitting to a low pressure fitting across the compressor of an air conditioning system where it filters and dries the system refrigerant where it is in the hot vapor state while the compressor is running.

11. The refrigerant auxiliary filter/drier unit of claim 8, wherein said screw top is removeable from said screw top cylindrical container and desiccant containing filter screen member is removeable as a cartridge from said screw top cylindrical container with the container then fillable with fluid additive from an additive supply container; said screw top then tightened down on said screw top cylindrical container; and then said screw on fitting is then connected to a high pressure fluid source for driving the fluid additive from said screw top cylindrical container to charge the air conditioning system.

12. The refrigerant auxiliary filter/drier unit of claim 11, wherein said high pressure fluid source is a refrigerant supply can.

13. The refrigerant auxiliary filter/drier unit of claim 11, wherein said high pressure fluid source is the high pressure fitting of an air conditioning system when the compressor of the system is running.

14. An air conditioner refrigerant auxiliary filter/-drier unit comprising: a screw top cylindrical container that may be opened and closed with a screw top that seals the container against leakage when threaded down; a fluid inlet transfer line connected to said screw top for the feeding of fluid through opening means in said screw top and extended to a screw on fitting connectable to a high pressure fitting of an air conditioning system; an opening connection at the bottom of said screw top cylindrical container; a fluid outlet transfer line connected to said opening connection and extended to a screw on fitting connectable to a low pressure fitting of an air conditioning system; and a desiccant holder placeable in said screw top cylindrical container; wherein seal means is positioned between the top rim of said screw top cylindrical container and the inside top surface of said screw top; check valve means is included with said screw on fitting connected to said fluid outlet transfer line; and said cylindrical container is sized to hold a fluid charge of refrigerant additive when said desiccant holder is removed from said cylindrical container for, with said screw top tightened down and then with said screw on fitting connected to a high pressure fluid source, driving of fluid additive from said screw top cylindrical container to charge the air conditioning system.

15. The refrigerant auxiliary filter/drier unit of claim 14, wherein said cylindrical container is sized to hold approximately a two ounce charge of refrigerant additive.

16. The refrigerant auxiliary filter/drier unit of claim 14, wherein said high pressure fluid source is a refrigerant supply can.

17. The refrigerant auxiliary filter/drier unit of claim 14, wherein said high pressure fluid source is the high pressure fitting of an air conditioning system when the compressor of the system is running.

* * * * *